United States Patent [19]

Strudel et al.

[11] 4,306,340

[45] Dec. 22, 1981

[54] EXTERNALLY HELD CYLINDRICAL SPREADING MEANS FOR TUBULAR FABRIC

[75] Inventors: Werner Strudel, Friedrichshafen, Fed. Rep. of Germany; Christian Strahm, Küsnacht, Switzerland

[73] Assignee: Lindauer Dornier Gesellschaft mbH, Fed. Rep. of Germany

[21] Appl. No.: 153,096

[22] Filed: May 27, 1980

[30] Foreign Application Priority Data

Jun. 28, 1979 [DE] Fed. Rep. of Germany ..... 2926117

[51] Int. Cl.[3] ..... D06C 5/00

[52] U.S. Cl. ..... 26/85

[58] Field of Search ..... 26/80, 81, 83, 84, 85; 264/290.2

[56] References Cited

U.S. PATENT DOCUMENTS 2,507,599 5/1950 Johnson ..... 26/84

FOREIGN PATENT DOCUMENTS 43-20394 9/1968 Japan ..... 26/83

49-6543 2/1974 Japan ..... 264/290.2

2035404 6/1980 United Kingdom ..... 26/85

*Primary Examiner*—Robert Mackey

*Attorney, Agent, or Firm*—James E. Bryan

[57] ABSTRACT

This invention relates to an improvement in an externally held cylindrical spreading means for tubular fabric, particularly for the treatment of the fabric with a fluid treating agent, with a central carrier for radially displaceable supports and segment-like guide elements carried by the supports, body means at each end of the central carrier, each of the body means being tapered in the longitudinal direction, and the guide elements extending in the longitudinal direction of the spreading means between the body means, the improvement comprising that the spreading means includes a pair of threaded sleeves mounted on opposite threads on the central carrier, radially-extending means with external magnetic pole means non-rotatably connected to the central carrier, and means for applying an external magnetic force on the magnetic pole means whereby the central carrier may be rotated.

3 Claims, 1 Drawing Figure

EXTERNALLY HELD CYLINDRICAL SPREADING MEANS FOR TUBULAR FABRIC

Figure 1:
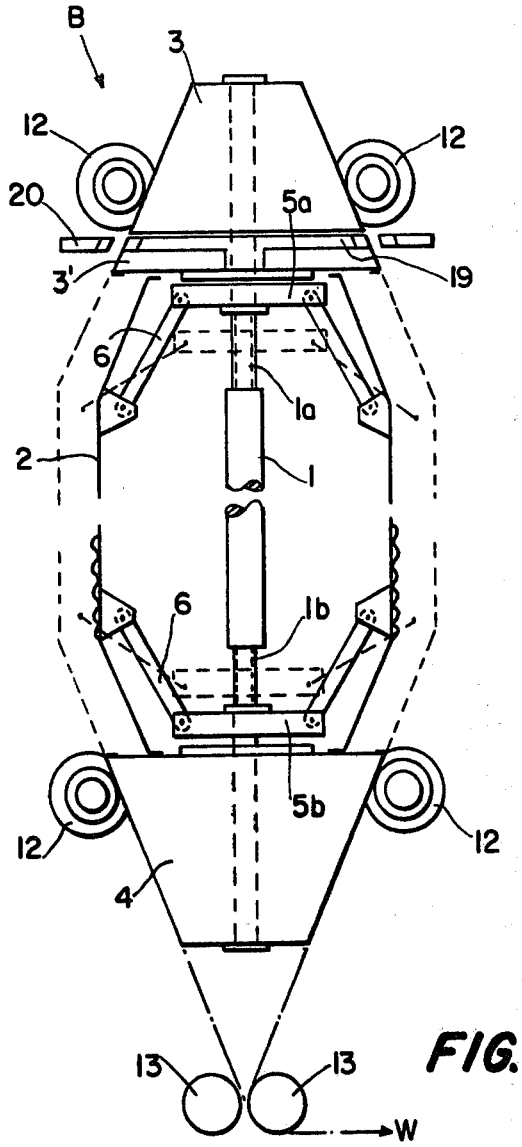

Copending application Ser. No. 092,100, filed Nov. 7, 1979, relates to an externally held cylindrical spreading means for tubular fabric with a central carrier for radially displaceable supports and segment-like guide elements carried by the supports, in particular for treating the fabric with a fluid treating agent. Bodies tapering in the longitudinal direction are mounted to the ends of the central carrier and act as retraction and extension means and between which the guide elements are arranged in the longitudinal direction of the spreading means. Furthermore, supporting and transporting rollers rest against these bodies, the supporting and transporting rollers having profiles adapted to the form of the tapered bodies.

In order to keep the fabric tensioned during operation, the spreading means diameter must be adapted to the particular fabric being treated. The copending application, supra, discloses a simple embodiment permitting manual widening of the spreading means. To that end the central carrier is provided at the top and bottom with threads in mutually opposite directions and on which are seated threaded sleeves in such a manner that by rotating the carrier the threaded sleeves can be brought closer or separated from each other along the mutually opposite threads. Movably supported levers extend radially obliquely outwardly from these threaded sleeves to the longitudinal guide elements of the spreading means. When the carrier is rotated, the threaded sleeves are displaced and thereby the guide elements are moved more or less outwardly or inwardly and hence the spreading means thereby will be widened or narrowed. The rotation of the carrier takes place manually in the apparatus of the copending application, supra, by hand wheels mounted at the ends of the tapered bodies.

The handwheels for adjusting the spreading means can be easily rotated only when no fabric as yet is being pulled over the spreading means. Accordingly, spreading means adjustment essentially must be made prior to the introduction of the fabric. This circumstance is a drawback in operation, and therefore it is the object of the invention to so improve the spreading means described in the copending application, supra, that is widening its also possible after the fabric has been introduced. This problem is solved by the invention in that the sleeves are designed, in known manner, as threaded sleeves and are rotatably mounted on oppositely winding threads of the carrier supported in the tapered bodies, in that a radially located component with salient external magnetic poles is mounted in a non-rotational manner on the carrier, and that the component can be rotatd by an externally applied magnetic force.

An embodiment of the invention is described below in relation to the drawing, in which:

FIG. 1 is an adjusting means for the spreading means using magnetic force.

The spreading means B shown in FIG. 1 is of the type described in the copending application, supra. A central carrier 1 terminates at both its ends by the tapered retraction or extension bodies 3 or 4, respectively. The carrier 1 is provided with oppositely winding threaded means 1*a* and 1*b* having the threaded sleeves 5*a* and 5*b* thereon. Guide elements 2 extend between the two tapered bodies 3 or 4. These guide elements are shown in solid lines for the retracted position and in phantom for the extended position of the spreading means. All of the spreading means B is supported by the supporting and transporting rollers 12 which are braced against the body 4. The path of the fabric is shown in dash-dot manner at the geometric extension of the tapered body 4. It is taken off by means of the pair of discharge rollers 13 in the direction shown by the arrow. The guide elements 2 are connected in hinged manner by means of support levers 6 with the displaceable sleeves 5*a* or 5*b*.

The sleeves 5*a* and 5*b* are axially displaceable on the carrier 1 by means of the threaded means 1*a* and 1*b* on the carrier 1.

A component 19 is mounted in non-rotational manner on the central carrier 1, extending radially, and includes outwardly salient magnetic poles, for instance a permanent magnet in the form of a bar magnet. However, the component 19 also may have other shapes, for instance that of a disc. Magnets 20 are mounted outside the spreading means B and can be moved around the spreading means B in a circular manner. In performing this motion, the magnets 20, when of the proper polarity, carry along the component 19 and thereby rotate the spindle of the central carrier 1 for the purpose of adjusting the threaded sleeves 5*a* and 5*b*, and hence to adjust the guide elements 2. The magnetic component 19 advantageously is seated in one of the tapered bodies 3 or 4, for instance in a slot between body 3 and 3'. In this manner, the magnetic poles may be arranged far to the outside and nevertheless the fabric W can be carried over the body 3 and the slot without being stressed. The initiation of the rotation can be performed not only by magnets 20 spatially moved in circular manner around the spreading means, but it is also feasible in other ways, for instance by rotating magnetic fields, which are generated in known manner by currents passing through windings.

It will be obvious to those skilled in the art that many modifications may be made within the scope of the present invention without departing from the spirit thereof, and the invention includes all such modifications.

What we claim is:

1. In an externally held cylindrical spreading means for tubular fabric with a central carrier for radially displaceable supports and segment-like guide elements carried by the supports, body means at each end of the central carrier, each of said body means being tapered in the longitudinal direction, and said guide elements extending in the longitudinal direction of said spreading means between said body means, the improvement comprising that said spreading means includes a pair of threaded sleeves mounted on opposite threads on said central carrier, radially-extending means with external magnetic pole means non-rotatably connected to said central carrier, and means for applying an external magnetic force on said magnetic pole means whereby movement of the external magnetic force applying means induces rotation of the central carrier to effect radial displacement of the supports.

2. A spreading means according to claim 1 in which said radially-extending means is a disc mounted in one of said tapered body means.

3. A spreading means according to claim 1 in which said means for applying an external magnetic force on said magnetic pole means is a system for generating a magnetic rotational field enclosing said radially-extending means.

* * * * *